United States Patent [19]

Svilar et al.

[11] Patent Number: 4,606,768

[45] Date of Patent: Aug. 19, 1986

[54] HIGH IMPACT STRENGTH POWDER METAL PART AND METHOD FOR MAKING SAME

[75] Inventors: Mark Svilar, University Heights; Stephen Glancy, Akron; Erhard Klar, Beachwood, all of Ohio

[73] Assignee: SCM Corporation, New York, N.Y.

[21] Appl. No.: 755,282

[22] Filed: Jul. 15, 1985

[51] Int. Cl.[4] ..... B22F 3/00

[52] U.S. Cl. ..... 75/246; 75/125; 75/129; 419/2; 419/5; 419/6; 419/27; 419/29; 419/38; 419/60

[58] Field of Search ..... 419/27, 60, 2, 5, 6, 419/29, 38; 75/246, 125, 129

[56] References Cited

U.S. PATENT DOCUMENTS

| | | | |
|---|---|---|---|
| 2,768,917 | 10/1956 | Pettibone | 148/12.4 |
| 3,343,954 | 9/1967 | Brab | 419/27 |
| 3,459,547 | 8/1969 | Andreotti et al. | 419/27 |

OTHER PUBLICATIONS

The Production and Properties of Novel Sintered Alloys (Infiltrated Alloys), Berg und Huttenmannische Monatshefte, vol. 94 (No. 8/9), 1949, pp. 284–294.

The International Journal of Powder Metallurgy & Powder Technology, vol. 17, No. 4, 1981, pp. 277 thru 289—Rostoker & Clemens.

Copper Infiltration of Steel: Properties and Applications, Progress in Powder Metallurgy (H. S. Nayar et al, editors), vol. 39, pp. 163–182.

Strengthening of Iron and Powder Compacts by Infiltration", Modern Developments in Powder Metallurgy (Hausner & Smith, editors), 1973, pp. 135–147.

*Primary Examiner*—Stephen J. Lechert, Jr.

*Attorney, Agent, or Firm*—Richard H. Thomas

[57] ABSTRACT

A copper infiltrated ferrous powder metal part infiltrated with copper or a copper alloy characterized as having after infiltration a residual uninfiltrated porosity of less than about 7 volume percent and a maximum pore size of the residual uninfiltrated porosity of less than about 125 micrometers, said porosity and pore size values being taken from a worst field of view in a functionally critical area of said metal part.

13 Claims, 2 Drawing Figures

HIGH IMPACT STRENGTH POWDER METAL PART AND METHOD FOR MAKING SAME

TECHNICAL FIELD

The present invention relates to infiltrated, ferrous powder metal parts having high impact strength, and to a method for making the same.

The present invention will be particularly described with reference to the infiltration of ferrous powder metal parts employing copper based materials as infiltrants.

BACKGROUND OF THE PRESENT INVENTION

Conventional ferrous, powder metal parts produced by simple pressing and sintering are known to have rather low dynamic properties; that is, impact and fatigue strength, because of the presence of the pores in such parts. Approaches to overcome this drawback include various methods for achieving full or nearly full density.

One of the least expensive methods to achieve nearly full density is to infiltrate such parts with copper or a copper based infiltrant. Infiltration of porous iron and steel parts with copper has been in commercial use since the 1940's. The most common reason for using this process is to improve the mechanical properties of a powder metallurgy part.

In spite of the ability to achieve nearly full density by infiltration with a suitable infiltrant, published data on copper infiltrated ferrous powder metal parts shows only small improvement in dynamic properties over uninfiltrated parts.

The impact strength of powder metal parts is important for many end use applications. One example is gear parts. A critical area of a gear part is at the root of the gear teeth, and a weakness in this area creates a potential for gear failure. In determining impact strength on gear teeth, a special tool applies a tangential force to a gear tooth, and the impact strength is essentially the energy necessary to establish failure in the gear critical area.

Another example of a powder metal part in which impact strength is important, is the hammer used in a hammer-type mill, such as found in a garbage disposal unit. A plurality of hammers are secured to a rotor by means of bolts. The hammer is provided with a slotted shank, in which the securing bolt slides, and a hammer head. The critical area is that area between the head and shank, and as with gear teeth, an imperfection in the critical area creates a potential for failure.

The impact strength for these hammers is determined by subjecting the hammer shanks to a side-directed moment of force and, here also, the energy necessary to establish failure is essentially the impact strength.

A conventional method for determining impact strength of specimens is the Charpy impact test procedure described in the Metal Powder Industries Federation (MPIF) Standard 40, 1974 Metal Powder Industries Federation P.O. Box. 2054, Princeton, NJ 08540. In this test, unnotched specimens are formed into a defined rectangular shape having specified dimensions, and are placed in a pendulum-type impact machine with a capacity of at least 110 foot pounds (15.2 m-kg). The impact strength is the average of three tests reported to the nearest foot pound. Standard 40 is incorporated by reference herein. For purposes of the present application, the term impact strength, where used herein, shall mean, unless otherwise noted, the strength values obtained following the Charpy-type test procedure outlined in Standard 40.

Another mechanical property of interest in the preparation of many ferrous powder metal parts is the tensile strength. This property, and the test for determining it, are described in MPIF Standard 10, also incorporated by reference herein. An aspect of the tensile strength of a powder metal part is the elongation of the part that occurs prior to failure. In the present application, the tensile strength and elongation shall be given (unless otherwise stated) in terms of kips per square inch (ksi) and percent elongation (E%), respectively, following the procedure of Standard 10.

In the following Table 1, tensile strength data and impact toughness of typical powder metal parts, determined by the above MPIF tests are given. As can be appreciated from the data of Table 1, the impact strength improvement possible with copper infiltration is limited. Unnotched Charpy impact values range from 3 to 35 foot pounds for iron/carbon steels, less than 2 to 8 foot pounds for copper/iron steels, and only about 5 to about 25 foot pounds for copper infiltrated steels. These values represent the present state-of-the-art for powder metal parts. Also of interest in the data of Table 1 is the fact that, as a general rule, if the impact strength is increased the tensile strength tends to be less.

TABLE 1

TENSILE AND IMPACT DATA FOR P/M PARTS

| TYPE OF P/M PART/MPIF STD. | COMPOSITION Fe | C[1] | Cu | UTS/KSI | E % | IMPACT - FT LBS |
|---|---|---|---|---|---|---|
| Iron-Carbon | | | | | | |
| F-0000-10 | 97.7–100 | 0–0.3 | | 18 | 1.5 | 3 |
| F-0000-20 | | | | 38 | 7.0 | 35 |
| F-3008-30 | 97.1–99.4 | .6–.9 | | 42 | 1 | 4 |
| Copper-Steels | | | | | | |
| FC-0200-24 | 93.8–98.5 | 0–0.3 | 1.5–3.9 | 35 | 1 | 6 |
| FC-0200-90 | 93.8–98 | 0–0.3 | 1.5–3.9 | 100 | 1 | 5.9 |
| Copper Infiltrated Steels | | | | | | |
| FX-1008-50 | 82.2–91.4 | .6–.9 | 8–14.9 | 87 | 3.0 | 10 |
| FX-1008-110 HT[2] | 82.2–91.4 | .6–.9 | 8–14.9 | 120 | 0.5 | 7 |
| FX-1000-25 | 82.8–92 | 0–0.3 | 8–14.9 | 51 | 7 | 25 |
| FX-2000-25 | 72.7–85 | 0–0.3 | 15–25 | 46 | 3.0 | 15 |
| FX-2008-60 | 72.1–84.4 | .6–.9 | 15–25 | 80 | 1 | 7 |
| FX-2008-90 HT | 72.1–84.4 | .6–.9 | 15–25 | 100 | 0.5 | 5 |

TABLE 1-continued

| TENSILE AND IMPACT DATA FOR P/M PARTS | | | | | | |
|---|---|---|---|---|---|---|
| TYPE OF P/M | COMPOSITION | | | | | |
| PART/MPIF STD. | Fe | C[1] | Cu | UTS/KSI | E % | IMPACT - FT LBS |
| Ref. 1 | | | | 108 | 13.5 | 46 |

[1]% carbon in steel matrix
[2]heat treated

Reference 1 in the above table is a paper published in 1949, by R. Kieffer and F. Benesovsky, entitled "The Production and Properties of Novel Sintered Alloys (Infiltrated Alloys)", *Berg- und Huttenmannische Monatshefte,* Volume 94 (No. 8/9), 1949, pages 284–294. The paper reports that an impact strength of about 46 foot pounds can be obtained by sintering and infiltrating under hydrogen and then heat treating the infiltrated parts. However, even this figure is low.

U.S. Pat. No. 2,768,917 to Pettibone, dated Oct. 30, 1956, also discloses a two-step sintering and infiltrating process under hydrogen atmosphere for ferrous metal parts using a copper alloy infiltrant. On this patent no impact strength data is given.

Considering that copper infiltrated parts are nearly full dense structures, it is somewhat surprising that impact values of commercial copper infiltrated parts are generally less than about 15 foot pounds.

It is known to increase impact strength by the use of alloying procedures, or increasing the density of a part through double pressing and sintering, or by hot pressing or powder forging. All these processes are more expensive, particularly if they require the handling of hot compacts, presses to deform the parts, and expensive dies. Also, as reported by Rostoker and Clemens in *The International Journal of Powder Metallurgy and Powder Technology,* Volume 17, No. 4, 1981, pages 278–289/280, excessive reduction in pore size is undesirable, the initial sintered density level representing a compromise between the necessity for interconnection between voids and undesirably excessive void volume.

In a procedure reported by Rostoker and Clemens, on page 280, minus 200 mesh iron powder specimens were compacted in one inch diameter cylinders to a green density of 6.55–6.60 grams/cm$^3$. The specimens were dewaxed for 2.5 hours at 625° C. with nitrogen, and then sintered in vacuum ($1\times10^{-4}$ torr) at 1150° C., for one hour. Infiltration with a copper manganese alloy (e.g., 14% Mn) was then carried out under vacuum at 1100° C. for three hours. There is no reference in the article to impact strength, nor is there any suggestion that the use of this procedure could give improved impact strength. In fact, the paper reports, on page 285, ". . . In all cases general yielding (a resolvable yield stress) is absent before fracture. Achievement of a yield stress as well as high tensile strength is an important objective which has not been realized . . . ", implying very low impact strength. Suggested possible causes given were a degradation of the toughness of the steel matrix, residual stresses, and a weak interface between the steel and copper alloy.

In recent years, several other investigators have also attempted to utilize the well developed theories of liquid metal infiltration for the purpose of raising the mechanical properties of copper infiltrated parts.

By way of example, it is described in a paper by Ashurst et al "Copper infiltration of steel: Properties and Applications," *Progress in Powder Metallurgy,* (H. S. Nayar et al, editors), volume 39, pages 163–182, that impact toughness of copper infiltrated steels can be increased up to about 30 foot pounds through control of erosion. This was minimized through proper metallurgical formulation of the copper infiltrant, and strategic placement of the infiltrant slug onto the steel part.

In 1973, Kimura & Hamamoto, in a publication entitled "Strengthening of Iron and Powder Compacts by Infiltration", *Modern Developments in Powder Metallurgy,* (H. H. Hausner and W. E. Smith, Eds.), 1973, pp. 135–147, the low mechanical properties of copper infiltrated parts are attributed to the great discrepancy in strength between the steel matrix and the copper phase.

DISCLOSURE OF INVENTION

The present invention resides principally in the discovery that the residual porosity after infiltration and maximum pore size of uninfiltrated porosity is a critical aspect of high impact strength. More specifically, the present invention resides in the discovery that a powder metal iron or steel part infiltrated with a copper or copper alloy; having after infiltration a residual uninfiltrated porosity of less than about 7 volume percent, and a maximum pore size of the residual uninfiltrated porosity of less than about 125 micrometers, wherein both values are taken from a worst field of view in a functionaly critical area gives consistently high impact strength values of more than 40 foot pounds while at the same time maintaining high ultimate tensile strength values greater than 49 ksi. These values are obtained in the as-infiltrated condition, prior to any heat treatment.

For purposes of the present invention, the critical area is defined as that area adjacent a fractured surface of an infiltrated part subjected to failure obtained by clean cutting-off the fractured surface and polishing the cut area. The worst field of view is obtained by viewing and analyzing a plurality of views of the cut polished surface. In the present invention, 50 fields of view are analyzed to obtain a worst field of view. Residual uninfiltrated porosity and maximum pore size data is obtained by measurement under magnification. The volume percent porosity is obtained from the area measurement following a procedure outlined in pages 446–449 of the National Bureau of Standards Publication 431, dated January, 1976 (incorporated by reference herein). Preferably, the worst field of view has a porosity less than about 5 percent and a maximum pore size of residual uninfiltrated porosity of less than about 75 micrometers.

Also, for purposes of the present application, the term "powder metal iron or steel" includes plain carbon steels, tool steels, stainless steels, and low alloy steels such as 4600. Typical alloying elements may be nickel, molybdenum, chromium, silicon and boron. Tool steels may contain such elements as vanadium and tungsten.

Also, in a preferred embodiment the infiltrant is copper, containing typically an alloying constituent such as iron, tin, zinc, silver, lithium, silicon, manganese, chromium, zirconium, and combinations thereof.

The present invention also resides in a novel process for infiltration of powdered metal iron or steel parts yielding impact strength values greater than 40 foot pounds and ultimate tensile strength values greater than 49 ksi in the as-sintered condition, characterized by the steps of; filling a die with powdered metal to achieve uniform powder metal distribution in said die; pressing said powdered metal to a density of at least about 80% of theoretical or full density; sintering said powder metal under vacuum conditions; infiltrating such powdered metal pores with a copper or copper alloy infiltrant, the infiltration also being carried out under vacuum, the part having a worst field of view uninfiltrated porosity in a functionally critical area of less than about 7 volume percent and a maximum pore size of residual uninfiltrated porosity of less than about 125 micrometers.

BRIEF DESCRIPTION OF THE DRAWINGS

The present invention will become more apparent from the following specification, with reference to the accompanying photomicrographs, in which.

BEST MODE FOR CARRYING OUT THE INVENTION AND INDUSTRIAL APPLICABILITY

Figure 1:
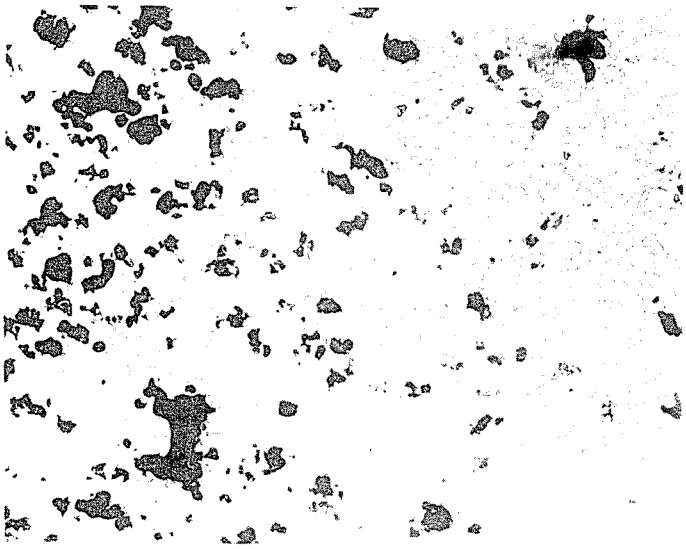
FIG. 1 is a field of view photomicrograph at 50 magnification, showing a plain, polished cross-section of a specimen part having high localized porosity.

The method of the present invention resides broadly in the steps of carefully filling a die with powdered metal to obtain uniform distribution of powder metal within said die. This includes drawing an instrument across the surface of the die to assure a level fill or surface of the powder metal in the die. At this point, the powder metal is subjected to pressing to obtain a density of at least about 80% of theoretical or full density. Then, the powder metal is subjected to vacuum sintering under conventional sintering conditions (vacuum and temperature), which may vary with the powdered metal being employed. A vacuum of about 0.3 Torr is representative. In this regard, vacuum sintering, although old, is usually not employed for carbon steel or iron powder metal because it is too expensive. It is justified in the present instance because of the improved properties obtained. Vacuum sintering is then followed by infiltration employing conventional infiltrating temperatures. However, the infiltration is also carried out under vacuum to eliminate residual gases which may be trapped in the pores. Preferably, these steps are followed by heat treatment under austenitizing conditions to improve the ductility of the powder metal part.

Critical in the above is carrying out the process steps in such a way as to obtain the maximum percent porosity and pore size herein previously specified.

As an alternative to vacuum sintering and infiltration, good results can be obtained by sintering and infiltrating under a hydrogen atmosphere.

The following examples are illustrative of the concepts of the present invention. In the following Examples, tensile strength is given in terms of kips per square inch (ksi). One kip equals 1000 pounds. Density is given in terms of grams per cubic centimeter (g/cc).

EXAMPLE 1

Izod Impact specimens (MPIF Standard 40) were pressed from a commercially available atomized iron blend (marketed by Hoeganaes under the trademark Ancorsteel 1000) having 0.9% graphite and 0.75% zinc stearate. The pressing was carried out to a density of about 7.1 g/cc, or about 90% of theoretical. Special care was taken to assure uniform and even die fill.

Sintering was carried out under vacuum, using helium at a partial pressure of 300 millimeters mercury (0.3 Torr). The sintering cycle was 1400° F. for 30 minutes and 2050° F. for 30 minutes. Cooling time to room temperature was about 1 hour.

A minimal erosion infiltrant slug (SCM Metal Products IP 204, a prealloyed copper infiltrant having 2–3% iron, 0.5–1.5% manganese, other 0.5–1.0%, lubricant 0.5%) weighing 12.8% of the impact specimen, was placed on top of one end of the specimen and infiltration was carried out under vacuum using the same cycle as described for the sintering treatment. The weight of the slug was sufficient to provide about 5–10% excess infiltrant over that required.

The infiltrated specimens were then austenitized by placing the specimens in a furnace at 1652° F. for 30 minutes (the specimens were at the temperature of 1652° F. for approximately 10 minutes) followed by water quench and tempering for 1 hour at 1157° F. under an inert atmosphere.

The Izod bar length was then reduced to that of the standard Charpy bar (MPIF Standard 40). Impact values obtained were 130, 131, and 99 foot pounds for a set of three bars. The tensile strength of the dog bone tensile bars (MPIF Standard 10) processed the same way as the impact bars, was 103 KSI.

The specimens showed no signs of erosion when viewed under a low magnification stereo-microscope. The Archimedes density of the parts was about 7.80 g/cc, or nearly full density. Uninfiltrated porosity was determined by considering only the worst field of view (914 micrometers by 1371 micrometers) taken from viewing 50 fields of view of a cross-section near the fracture surface. The largest pore size observed in 50 random fields of view was less than 55 micrometers. The worst field porosity was 0.8% for the specimen with an impact toughness of 131 foot pounds, and 1.6% porosity for the specimen having 99 foot pounds.

Figure 2:
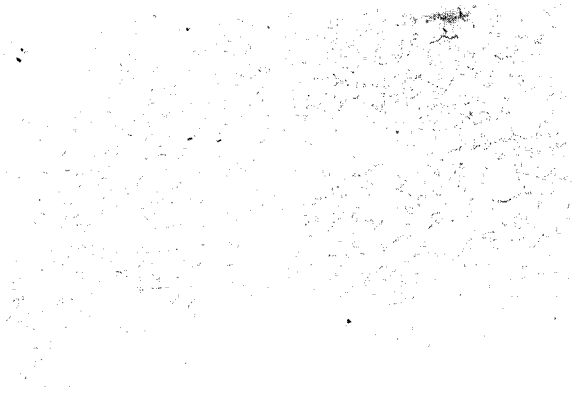
FIG. 2 is a field of view photomicrograph at 50 power, of a specimen prepared in accordance with the concepts of the present invention, specifically a specimen prepared by the procedure of Example 1.

FIG. 2 is a field of view photomicrograph taken at 50 power of the specimen having an impact strength of 131 foot pounds. In this photomicrograph, the light areas are the iron matrix and the greyish areas are the copper infiltrant. The photomicrograph shows no uninfiltrated porosity. This was a typical view taken of the functionally critical area. By contrast, the specimen of FIG. 1 had high porosity (the black areas of FIG. 1). The specimen was obtained following a procedure similar to the above procedure, except that the sintering was not carried out under vacuum. The view of FIG. 1 was illustrative of the functionally critical area porosity of this sample. A worst field of view was measured to have 23% porosity and a maximum pore size of 300 micrometers. Impact strength for this specimen was only 27 foot pounds.

This comparitive data dramatically illustrates the importance of residual porosity on impact strength.

The impact values of the three specimens of this Example were substantially 3 times those reported by Kieffer and Benesovsky using similar heat treatment after infiltration. This large difference (nearly 90 foot pounds) clearly demonstrates the advantages of the present invention. With regard to the general state-of-the-art, the data obtained represented a nearly 10-fold improvement. It should also be noted that high impact values were obtained while retaining good tensile strength.

EXAMPLE 2

Samples were prepared following the procedure of Example 1, except that the green specimens were pressed to a density of 6.7 g/cc rather than 7.1 gram per cc. Also, a slug weight of 20.5%, based on the matrix weight, was employed.

Of two samples prepared, impact strength of 80 and 85 foot pounds, respectively, were obtained. The ultimate tensile strength of dog bone tensile bars (MPIF Standard 10), processed the same way as the impact bars, was 92 ksi.

The specimens showed no signs of erosion when viewed under a low magnification stereo-microscope. The Archimedes density of the parts was 7.88 g/cc. Uninfiltrated porosity was determined by considering only the worst field of view (914 micrometers by 1371 micrometers) taken from viewing 50 fields of view of a cross-section near the fracture surface. The largest pore size observed in 50 random fields of view was less than 100 micrometers. The percent porosity was 1.1% for the specimen, with an impact toughness of 80 foot pounds, and 3.5% porosity for the specimen having 85 foot pounds impact strength.

These impact values are substantially twice those reported by Kieffer and Benesovsky, using similar heat treatment after infiltration. This example also clearly demonstrates the advantages of the present invention over simple heat treatment.

EXAMPLE 3

This Example was carried out following the procedure of Example 1, except the specimens were not heat treated after infiltration. The impact strength was about 52 foot pounds (average of 3 specimens), and an ultimate tensile strength of about 124 ksi was obtained. Impact values for the set of 3 bars were 56, 50 and 49 foot pounds, respectively. The specimens showed no signs of erosion when viewed under a low magnification stereo-microscope. The Archimedes density of the parts was 7.88 g/cc. Uninfiltrated porosity as determined by considering only the worst field of view (914 micrometers by 1371 micrometers) was taken from viewing 50 fields of view of a cross-section near the fracture surface. The largest pore size observed in 50 random fields of view was less than 118 micrometers. Actual percent porosity was 1% for the specimen, with an impact toughness of 56 foot pounds, and 1.8% porosity for the specimen having 49 foot pounds.

This Example illustrates that even without the heat treatment of Kieffer and Benesovsky, data as good as that reported by Kieffer and Benesovsky can be obtained.

The Example also illustrates the heat treatment is beneficial and, although there is some loss of tensile strength resulting from heat treatment (for instance by comparison with the data of Example 1), the tradeoff is small compared to the substantial gain in impact strength achieved. In other words, by the procedure of the present invention, high impact strengths are obtained without substantial reduction in tensile strength. Normally, tensile strength and impact strength are inversely related.

EXAMPLE 4

The purpose of this Example is to demonstrate that small pore size and low porosity values can be obtained by other than the double vacuum procedure of Examples 1–3, and that regardless of how obtained, the same give correspondingly good impact and tensile strength.

In this Example, sintering and infiltrating were carried out under a hydrogen atmosphere rather than vacuum. This is similar to the procedure of Kieffer and Benesovsky. However, in contrast to Kieffer and Benesovsky, the sintering and infiltrating was not followed up by heat treatment. As will be shown, results even without heat treatment were substantially better than those obtained by Kieffer and Benesovsky were obtained. It is not known why Kieffer and Benesovsky did not report better results. Pore size and porosity data were not reported in the Kieffer and Benesovsky paper, and there is no way of ascertaining what these values might have been.

Izod impact specimens (MPIF Standard 40) were pressed from a blend of atomized iron with 0.4% graphite and 0.75% zinc stearate to a density of 6.7 g/cc. Sintering was carried out in a belt furnace under hydrogen with a preheat of 1400° F. for 30 minutes, and a high heat of 2050° F. for 30 minutes.

Minimal erosion infiltrant (SCM Metal Products IP 204), in the form of a slug weighing 19% of the matrix weight, was placed at one end of the specimens and infiltration was carried out under the same conditions as described above, for sintering.

The infiltrated specimens were cut to a Charpy length, as described in Example 1. Impact values up to 86 foot pounds with tensile strength of 46 ksi were obtained in the as-infiltrated condition.

This Example illustrates an alternative procedure to sintering and infiltrating under a vacuum, namely, sintering and infiltrating under hydrogen atmosphere.

Although the results obtained were not as good as those of Examples 1 and 2, substantial improvement over the results reported by Kieffer and Benesovsky were obtained. For instance, again, Kieffer and Benesovsky achieved an impact value of 46 foot pounds, but only following heat treatment.

EXAMPLE 5

The purpose of this Example is to illustrate that careful die filling is an important aspect of the present invention. Careful die filling is simply making sure that the die cavity is uniformly filled. For instance, it is important that the upper surface of the powder metal in the die be as level as possible.

In this Example, processing was carried out using the same method employed in Example 2, except that the specimens were not heat treated after sintering. Also, careful die filling was not practiced for some specimens.

| Careful Die Filling Practice Impact Strength* ft/lbs. | Typical Die Filling Practice Impact Strength* ft./lbs |
|---|---|
| 47 | 35 |
| 47 | 43 |
| 47 | 45 |
| 43 | 31 |
| 45 | 31 |

-continued

| | Careful Die Filling Practice Impact Strength* ft/lbs. | Typical Die Filling Practice Impact Strength* ft./lbs |
|---|---|---|
| Average ($\overline{X}$): | 45.8 | 37.2 |
| Std. Deviation (S) | 1.79 | 5.60 |
| Range: | 43 to 47 ft lbs | 31 to 45 ft lbs |
| $\overline{X}$-3S:** | 40.4 ft lbs | 20.4 ft lbs |

*as measured by unnotched Charpy Impact Test.

**standard quality control practice involves subtracting 3 times the standard deviation from the average (X).

Careful die filling significantly improved the impact strength and reduced the scatter as measured by the standard deviation. A standard quality control practice is to set minimum values at the mean minus three times the standard deviation. Careful die filling doubled the minimum value from 20 ft lbs to 40 ft lbs.

The above Examples clearly demonstrate that it is possible to obtain impact toughness to three times as high as reported in the literature for heat-treated specimens, and equal to reported literature heat-treated values as infiltrated. Such superior properties, in combination with good tensile strength, opens up many new uses to copper infiltration that, until now, could be met only with more expensive methods, such as hot pressing and powder forging.

While it is not intended that the present invention be limited to a particular explanation for the above, it is believed that small amounts of uninfiltrated, large residual pores, often not discernible by density techniques, but clearly visible by sectional metallography, act as stress raisers and prevent the attainment of superior impact toughness. While some published literature claims that it is the small pores that are more difficult to infiltrate, the present invention is based on the concept that the large pores are the most difficult to infiltrate, and which in an unfiltrated part may remain uninfiltrated, giving rise to low or variable impact toughness. Not only is the average impact toughness raised by eliminating these larger pores, but the scatter of the impact toughness of a lot of specimens, for instance as demonstrated in Example 5 is greatly reduced. This is of considerable importance.

It is also believed that the thorough reduction of the iron or steel matrix, obtained by 2-step infiltration (as opposed to single step infiltration or sintration), by extended one step sintration, or by vacuum sintering, enables the infiltration of large size pores which, without these results, the specimens would not become fully infiltrated. It is believed that the thorough reduction and lower oxygen content (typically less than 600 parts per million in the infiltrated part compared to about 1000 parts per million for conventional processing) raises the surface energies of both the matrix and the infiltrant and causes a rounding of the matrix pores. Both effects are believed to favor infiltration.

We claim:

1. A copper infiltrated ferrous powder metal part infiltrated with copper or a copper alloy characterized as having after infiltration a residual uninfiltrated porosity of less than about 7 volume percent and a maximum pore size of the residual uninfiltrated porosity of less than about 125 micrometers, said porosity and pore size values being taken from a worst field of view in a functionally critical area of said metal part.

2. The metal part of claim 1 wherein said porosity is less than about 5 volume percent, and said maximum pore size is less than about 75 micrometers.

3. The metal part of claims 1 or 2 wherein said ferrous metal is plain carbon steel, tool steel, or a low alloy steel.

4. The metal part of claim 3 wherein said infiltrant is copper alloyed with an alloying constituent selected from the group consisting of iron, tin, zinc, silver, lithium, silicon, manganese, chromium, zirconium, and combinations thereof.

5. The metal part of claim 1 having an as-infiltrated impact strength, as measured by the unnotched Charpy test, of greater than 40 foot pounds, and a tensile strength greater than 46 ksi.

6. The metal part of claim 1 having an impact strength, as measured by the unnotched Charpy test, of greater than 50 foot pounds, said metal part being heat treated using austenitizing conditions.

7. A process for infiltrating ferrous powder metal parts with a copper or copper alloy infiltrant to yield an impact strength, as measured by the unnotched Charpy test, of greater than 40 foot pounds, and an ultimate tensile strength of greater than 46 ksi, in the as-infiltrated condition, comprising the steps of;

a. filling a die with ferrous powder metal to achieve uniform powder metal distribution in said die;
b. pressing said powder metal to a density of at least about 80% of theoretical density;
c. sintering said powder metal under vacuum sintering conditions;
d. infiltrating said powder metal with a copper or copper alloy infiltrant under vacuum infiltrating conditions;
e. the filling, pressing, sintering and infiltrating conditions being effective to provide a powder metal part having a residual uninfiltrated porosity and a maximum pore size of residual uninfiltrated porosity, as taken from a worst field of view in a functionally critical area of said metal part, of less than about 7 volume percent and 125 micrometers, respectively.

8. The process of claim 7 wherein said porosity and maximum pore size are less than about 5 volume percent and 75 micrometers, respectively.

9. The process of claims 7 including the step of heat treating said metal part under austenitizing conditions, said part having an impact strength of greater than 50 foot pounds.

10. The process of claims 8 or 9 wherein said ferrous metal is plain carbon steel, tool steel, or a low alloy steel.

11. The process of claims 8 or 9 wherein said infiltrant is copper alloyed with an alloying constituent selected from the group consisting of iron, tin, zinc, silver, lithium, silicon, manganese, chromium, zirconium, and combinations thereof.

12. A copper infiltrated ferrous powder metal part as claimed in claim 1 prepared by the steps of a. filling a die with ferrous powder metal to achieve uniform powder metal distribution in said die;
b. pressing said powder metal to a density of at least about 80% of theoretical density;
c. sintering said powder metal under vacuum sintering conditions;
d. infiltrating said powder metal with a copper or copper alloy infiltrant under vacuum infiltrating conditions;

13. A copper infiltrated ferrous powder metal part as claimed in claim 1 prepared by the steps of a. filling a die with ferrous powder metal to achieve uniform powder metal distribution in said die;

b. pressing said powder metal to a density of at least about 80% of theoretical density;

c. sintering said powder metal under a hydrogen atmosphere using conditions effective for sintering; and d. infiltrating said powder metal also under a hydrogen atmosphere using conditions effective for infiltrating.

* * * * *